United States Patent [19]

Bürgers

[11] Patent Number: 4,467,576

[45] Date of Patent: Aug. 28, 1984

[54] OUTER FRAME FOR FACING A WALL OPENING

[76] Inventor: Helmut Bürgers, Hochgernstrasse 3, 8200 Rosenheim, Fed. Rep. of Germany

[21] Appl. No.: 440,568

[22] Filed: Nov. 10, 1982

[51] Int. Cl.[3] ..... E06B 1/04

[52] U.S. Cl. ..... 52/212; 49/505

[58] Field of Search ..... 52/212–214, 52/211, 217; 49/505

[56] References Cited

U.S. PATENT DOCUMENTS

| | | | |
|---|---|---|---|
| 3,324,599 | 6/1967 | Brost | 52/212 X |
| 3,808,758 | 5/1974 | Burgers | 52/212 |
| 4,179,849 | 12/1979 | Kuffner | 52/212 |

FOREIGN PATENT DOCUMENTS

| | | | |
|---|---|---|---|
| 350789 | 1/1961 | Switzerland | 52/212 |
| 595540 | 2/1978 | Switzerland | 52/212 |

*Primary Examiner*—J. Karl Bell

*Attorney, Agent, or Firm*—Becker, Becker, Inc.

[57] ABSTRACT

A frame which serves to cover a wall opening for a door, or to cover an existing old door frame. The frame includes a liner located before the wall opening soffit, and at least one covering arranged at right angles along at least one edge of the liner, which covering comprises a U-shaped, thin-walled profiled sheet. At least one rail extending in the longitudinal direction of the profiled member is arranged on the inner side of the base of the member for receiving fastening dowels which can be shifted in the rail; the fastening dowels can be inserted in wall-side bores. That leg of the profiled sheet member which faces the wall opening projects beyond the plane of the wall opening soffit. The plate-like liner is placed or mounted on the outer side of the leg. The liner is fastened by an insertable connection and is held together with the profiled member thereby.

4 Claims, 2 Drawing Figures

OUTER FRAME FOR FACING A WALL OPENING

Figure 1:
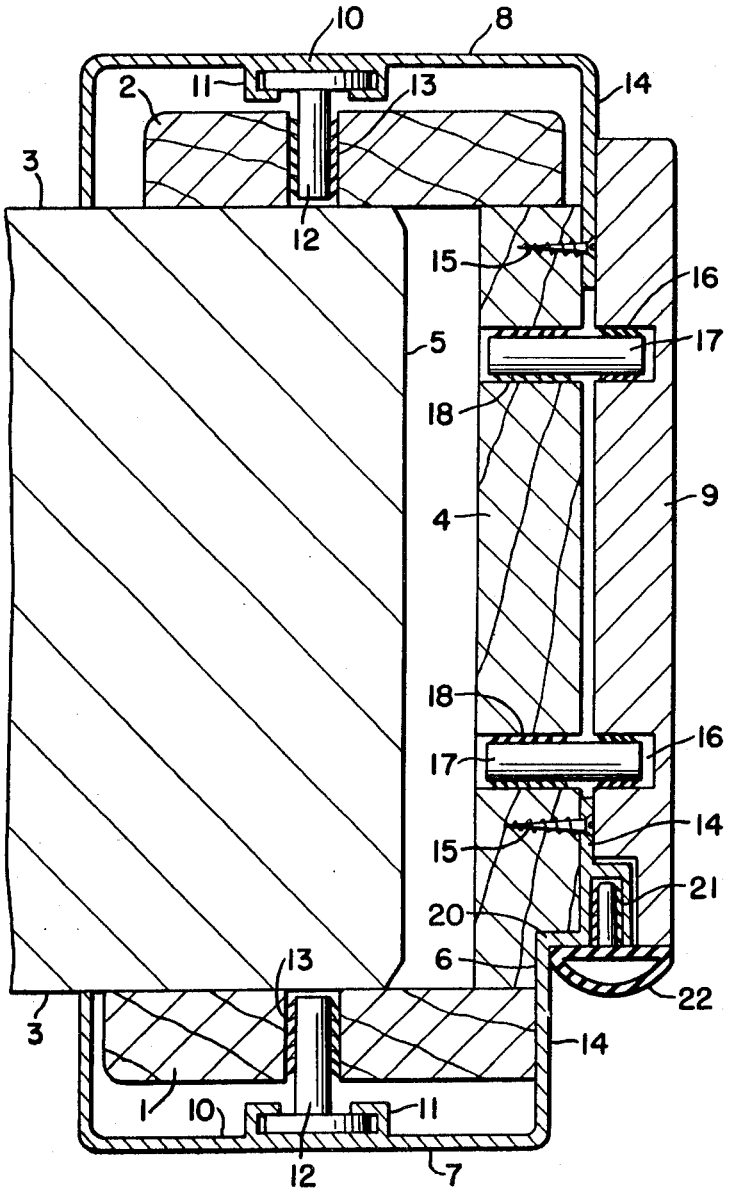

The present relates to an outer frame for covering or facing a wall opening for a door or the like. The frame includes a covering or liner located ahead of the soffit of the wall opening, and at least one covering located on the wall surface at right angles to the edge of the liner. The covering, on the not-visible inner side thereof facing the wall surface, is provided with fastening pins which extend at right angles to this inner side for connection with the wall. Furthermore, the liner has a fastening connection which is capable of being inserted.

U.S. Pat. No. 3,808,758 August Burgers dated May 7, 1974 discloses an outer frame which is intended for a door and is provided with a grooved covering and an ornamental or decorative covering, both of which comprise relatively thick-walled wood strips or panels which have blind holes on the inner side, facing the wall, for receiving dowels which can be inserted in blind holes in the wall. The fastening of the liner, which likewise consists of a wood strip or panel, is effected at the edges of the liner, likewise via dowels which can be inserted in blind holes of the liner and of the coverings. With old wood doors already existing in buildings, especially varnished doors, the surface of the wood parts, which has been damaged or has become unsightly, is frequently replaced by a new surface of durable foil-like synthetic material or of natural wood veneer. While an old door panel can be refinished or renovated relatively easily in a shop by known covering with a synthetic material foil, it is difficult and expensive to provide a rigidly installed old wood frame with a surface covering of synthetic material foil for conforming the surface thereof to the new door panel surface, especially when the surface of the old wood frame is wavy or damaged. If the old wood frame, with a simple replacement of the old door panel by a new door panel having a natural wood surface, likewise is to have a matched surface or natural wood veneer, then the old wood frame must be broken out of the wall opening for subsequent veneering in a shop or for replacement by a completely new frame, which causes considerable remodeling dirt, and usually requires a restoration of the damaged wall surfaces. In practice, it is often the case that old, usually lacquered steel frames existing in buildings, on the occasion of the renovation of the old wood door panels, likewise are to receive a conforming new surface of durable synthetic material, for instance in a wood decor or of natural wood foil. It is known to cover the coverings and also the liner of an old wood frame with a covering which consists of U-shaped holding strips, for example of metal, which are fastened with screws or nails in the form of a frame to the edges of the old frame, and between which fitting there are installed wood plates or panels with the new surface. This method is costly and cumbersome, especially with respect to an exact mounting of the covering; furthermore, this method cannot be used for covering an existing old steel frame.

It is an object of the present invention to provide a frame with which an existing old wood frame as well as an existing old steel frame can be covered for the purpose of surface renovation with the least possible mounting work and generation of dirt; the frame should also be suitable, for example in new buildings, as the initial frame for a still uncovered wall opening.

Figure 2:
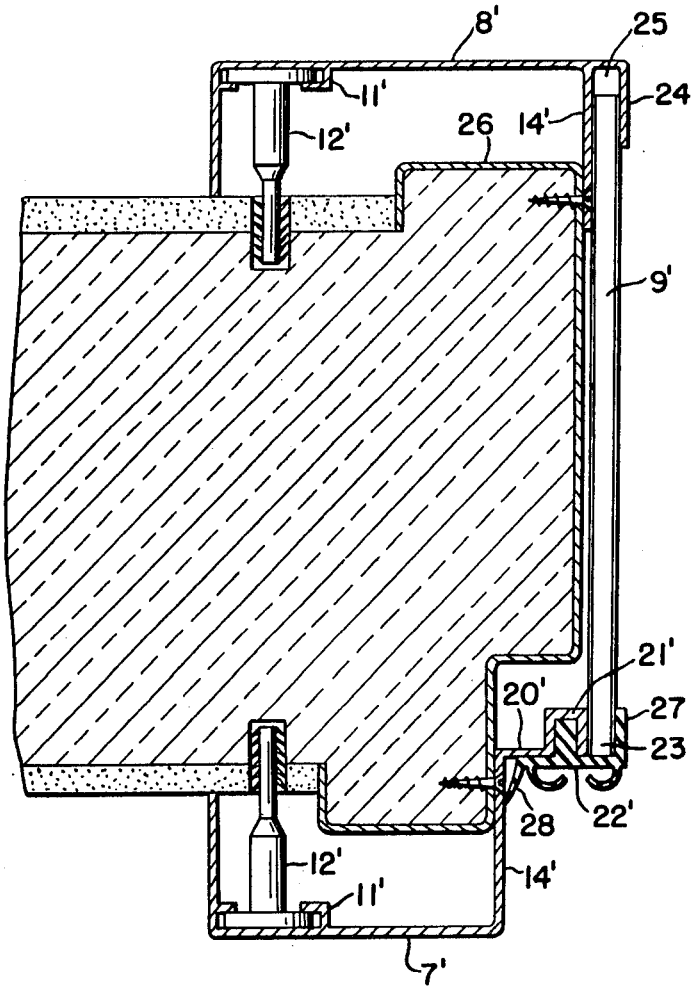

This object, and other objects and advantages of the present invention, will appear more clearly from the following specification in connection with the accompanying drawings, in which:

FIG. 1 is a cross section of one embodiment of the inventive frame covering an existing old wood frame; and FIG. 2 is a cross section of another embodiment of the inventive frame for covering an existing old steel frame.

Starting from a frame of the initially mentioned general type, the frame of the present invention is characterized primarily in that the covering comprises a U-shaped thin-walled profile sheet or plate which on the inner side of its base has at least one rail which extends in the longitudinal direction of the profile sheet, and which receives the enlarged end of fastening dowels which can be moved in the rail and can be inserted into bores on the wall side; that leg of the profiled sheet which faces the opening in the wall projects beyond the plane of the soffit of the wall opening, and the liner is placed or mounted on the outer side of this leg and is held securely by the insertable fastening connection.

When the inventive frame is used for normal room doors, with which the frame as a rule has two coverings—one on each of the opposite wall surfaces—each of the two coverings comprises a profiled member constructed in accordance with the present invention. The profiled sheet or plate, to fulfill different desires, be produced, for example, of aluminum with a color-anodized metallic surface, or, with the aid of conventional coating techniques, can be produced with an adhesively bonded surface of synthetic material foil or even of wood veneer. The open cross section of the profiled sheet can be dimensioned large enough that the most frequently used widths and thicknesses of the covering parts of the old wood frames can be covered with a single standard model of the inventive profiled sheet. For an invisible fastening of the profiled sheet, only that covering part of an existing old wood frame, which is to be covered, needs to be provided with several bores for the fastening dowels. Such bores are drilled easily and simply along a line on the old covering part and in alignment with the rail of the profiled sheet. The fastening dowels can be shifted in the rail of the sheet to any desired locations, for example, when during drilling, a hidden nail or the like is encountered in the old covering part, and a new bore must be drilled along the line which is aligned with the rail. When the frame is, for example, to be utilized for a new building, the profiled sheet can be fastened directly to the wall, whereby the fastening dowels, which are dimensioned sufficiently long, can be inserted directly into bores drilled in the wall surface; here, too, the fastening dowels can be shifted to the appropriate location in the rail of the sheet in the event that during drilling a wall joint is encountered which is not sufficient for holding a fastening member, and a new wall bore must be drilled along the fixed line at a different location. After fastening the profiled sheet, or in case a frame is used having two coverings, after the fastening of both sheets, that leg of the profiled sheet which faces the wall opening and projects beyond the plane of the soffit of the wall opening, forms an abutment for the liner of the inventive frame, so that the liner can be placed on this leg independently of unevenness of the wall opening soffit which is to be covered in a new construction, or of the liner part to be covered in an existing old frame, and so that the liner can rest fully and free of any joints on this leg. The liner of the frame according to the present invention, when the profiled sheet has a surface coating of synthetic material foil or wood veneer, can be a wood plate or panel with identical surface coating, or, when a metallic color-anodized aluminum surface is desired for the profiled sheet, the liner can comprise a wood plate with a surface of similarly appearing aluminum foil.

According to further advantageous embodiments of the present invention for the insertable fastening connection for holding the liner of the frame, that leg of one of the profiled sheets which faces the wall opening projects at least as far as into the plane of the surface of a blind or spacing liner of wood arranged at the wall opening soffit; the liner placed on this leg has, at least on its inner side a wood plate which has blind holes on the inner side thereof for receiving connecting dowels which can be inserted in bores of the blind liner.

That leg of one of the profiled sheets, which faces the wall opening, may be formed as a groove or recess for a door abutment, and on its grooved surface, which serves as the door abutment surface, may have a groove-like receiving pocket, which projects below the liner and into which pocket, the fastening rib of a profiled sealing member can be inserted which covers that edge surface of the liner which terminates flush with the grooved surface of the leg.

The sealing member may have a bent or angled-off portion at the edge of its grooved surface, which angled-off portion forms an insert groove with the receiving pocket for securely receiving and holding the edge of the liner; the frame may have a second U-shaped profiled plate or sheet which forms a second covering and which has an insert groove formed by a bent or angled-off portion of its edge, ahead of that leg thereof which faces the wall opening, for securely holding and receiving the other edge of the liner.

Referring now to the drawings in detail, the old wood frame which is illustrated in FIG. 1 and which is to be covered comprises: two facing or covering parts 1 and 2 which are disposed on both wall surfaces 3 of a wall; and a covering or lining part 4, which lines or covers the wall soffit surface 5. The edge of the old frame formed by the covering part 1 and the lining part 4 is made as a right-angle groove or recess 6 for a door abutment in the usual manner. The outer frame according to the present invention correspondingly also comprises three parts, including two coverings and one liner 9. The coverings each comprise a U-shaped, thin-walled profiled sheer or plate 7 or 8, which on the inner side of their base 10 each have a rail or track 11 extending in the longitudinal direction of the profiled member. The rail 11 receives the enlarged end of each of several fastening dowels 12, which ends are adapted to the open cross section of the rail. The fastening dowels 12 can be moved in the rails 11, and can be inserted into matchingly drilled bores 13 in the old covering part 1 or 2 which is to be covered. The bores 13 are drilled along a line which is aligned with the rail 11; this line is disposed in such a way that those legs 14, of both of the profiled sheets 7 and 8 which face the opening in the wall, project beyond the plane of the soffit of the inside wall openings. In the embodiment of FIG. 1, the lining part 4 of the old wood frame forms the soffit of the inside wall opening, and the legs 14 of the profiled members project at least as far as into the plane of the surface of the old lining part 4. As a result, the liner or covering 9 of the inventive frame can be placed or mounted fully and free of any joints on the leg 14 of the profiled member before an engagement of the liner 9 occurs with the old lining part 4. The old lining part 4 can also be used as a blind liner-like base for an insertable fastening of the liner or covering of the frame according to the present invention. In addition to this, the liner 9—which for covering the old lining part 4 need not be U-shaped and therefore can comprise a standard wood strip, or at least on the inner side can have a wood plate or panel—according to a further structural feature of the frame of the present invention is embodied with blind holes or bores 16 on the inner side of the wood strip; these bores 16 receive the connecting dowels 17. The connecting dowels 17 can be inserted in matchingly and identically correspondingly drilled bores 18 of the old lining part 4. The fastening dowels 12 and the connecting dowels 17 are advantageously synthetic material, ribbed or finned dowels which only need to be driven into the bores by the respectively necessary extent, and bind or catch in the bores with their ribs or fins in a barbed manner with high resistance against removal or tearing-out. The legs 14 of the profiled sheets or plates 7 and 8, which legs project beyond the plane of the surface of the old lining part 4, are advantageously of such a length that they partially cover the surface of the old lining part 4, and are provided with holes for nails or screws 15. As a result, the legs 14 of the profiled members can be fastened to the old lining part 4 at locations which are covered and hidden by the installed liner 9, and can be fastened to the old liner part 4 in such a way that with the use of only one rail 11 on the inner side of the profiled sheets 7 and 8, a tilting of the sheets about the fastening dowels 12 is avoided.

With the utilization of the embodiment of the frame illustrated in FIG. 1, for example in new buildings in which no old wood exists, only a single blind or spacing liner consisting of a rough wood board needs to be securely arranged on the soffit 5 of the wall, without costly alignment, in order to be able to fasten the liner or cover 9 on this blind liner by means of the connecting dowels 17. The fastening of the profiled sheets 7 and 8 is then effected via bores which are drilled directly into the wall surfaces 3 and into which appropriately longer fastening dowels 12 are inserted.

In a manner similar to that edge of the old wood frame which is formed by the parts 1 and 4 and is to be covered, the profiled sheet 7, which serves as a so-called groove, is formed as a groove or recess for a door abutment at that leg 14 of the profiled member which faces the wall opening, so that this leg 14 has a grooved surface 20 which serves as a door abutment surface. According to a further structural feature or embodiment of the present invention, this leg 14 of the profiled member 7 is constructed in such a way that at its grooved surface 20, the leg 14 has a groove-like receiving pocket 21 which projects below the correspondingly recessed liner 9. The fastening rib of a profiled sealing member 22 can be inserted into this recess or pocket 21. The sealing member 22 is of such a width that it covers that edge surface of the liner 9 which is flush with the grooved surface 20 of the leg 14 of the profiled member 7. As a result, the liner 9 can be prefabricated to such a width that it can be used for different wall opening soffit widths in new buildings, or for different liner part widths of existing old wood frames; the liner 9 need only be cut to the necessary fitting width when ready for mounting on the frame on the grooved edge thereof. The cut surface is covered by the profiled sealing member 22, and no longer needs to be provided subsequently with a new surface covering.

FIG. 2 shows another inventive embodiment of the outer frame, which can be produced especially economically, and which makes it possible to cover an existing old steel frame 26, though it can also be used equally well in new buildings for covering a still rough or unfinished wall opening. The coverings or linings, as with the embodiment of FIG. 1, comprise U-shaped, thin-walled profiled sheets or plates 7' and 8'. However, the rails 11' arranged on the inner sides are displaced or offset laterally to such an extent that the bores which receive the fastening dowels 12' in each case can be drilled in the wall laterally from the old steel frame 26. The profiled sheet 7, which serves as a grooved covering, has, as in the embodiment of FIG. 1, a grooved surface 20', as a door abutment surface, on its leg 14', which projects beyond the plane of the soffit of the inside wall opening formed by the old steel frame 26. On this surface 20' there is arranged a groove-like receiving pocket 21' which projects below the liner 9' for the fastening rib of a profiled sealing member 22'. The sealing member 22 according to the present invention, along the edge of its grooved surface 20' has a bent or angled-off portion 27 which, with the receiving pocket 21', forms an insert groove 23 for securely mounting the edge of the liner 9'. The other profiled sheet or plate 8', which forms the second covering of the frame, is provided ahead of its leg 14', which likewise projects beyond the plane of the wall opening soffit, with an insert groove 25, formed by a bent or angled-off portion 24 of the edge, for securely mounting the other edge of the liner 9'.

After fastening both of the profiled sheets 7' and 8', the liner 9' is placed on the leg 14' of the sheet 8'. The leg 14' advantageously is somewhat longer than the angled-off edge portion 24, and the liner 9' is pushed into the insert groove 25. Thereafter, the sealing member 22' needs only to be inserted in the receiving pocket 21', whereby simultaneously the other edge of the liner 9' is placed on that portion of the leg 14' of the sheet 7' which forms the receiving pocket 21', and is pushed into the insert groove 23. Thereafter, the liner 9' is supported and securely held at that distance from the old steel frame 26 desired for an exact alignment thereof. In order to avoid a tilting of the profiled sheets 7' and 8' about the fastening dowels 12', the legs 14' can be fastened to the old steel frame 26, for example, by a contact adhesive or, in a manner similar to the embodiment of FIG. 1, by driven-in connecting means. Driven-in connecting means on the leg 14' of the sheet 8' are covered by the liner 9' so as to be no longer visible. Connecting means driven-in on the leg 14' of the sheet 7' can be covered by an additional sealing lip 28 of the sealing member 22' so as to be no longer visible.

The present invention is, of course, in no way restricted to the specific disclosure of the specification and drawings, but also encompasses any modifications within the scope of the appended claims.

What I claim is:

1. A frame for covering an opening in a wall, and specifically for covering the soffit surface of said wall opening, and that part of at least one of the two wall surfaces adjacent said soffit surface, said frame comprising in combination:

a separate liner located ahead of, i.e. spaced from and substantially parallel to, said soffit surface;

at least one covering respectively located on one of said two wall surfaces at right angles to an adjacent edge of said separate liner; each covering comprises a U-shaped, thin-walled profiled member having a base which is substantially parallel to an associated wall surface, and two legs which extend perpendicular to said base; one leg of each of said profiled members faces said wall opening and projects beyond the plane of said soffit surface; said separate liner being mounted on the outer side of said one leg; each of said profiled members, on that side of said base thereof which faces the associated wall surface, being provided with at least one rail which extends in the longitudinal direction of said profiled member;

fastening dowels, each of which has an enlarged end which is adapted to be received by said rail in such a way as to be movable therein and to project at right angles therefrom toward the associated wall surface; that end of each of said fastening dowels remote from said enlarged end thereof being adapted to be inserted in bores operatively associated with said wall surface for effecting connection of said profiled member with said wall surface; and connection means for securely holding said separate liner on said one leg of said profiled member.

2. A frame for covering an opening in a wall, and specifically for covering the soffit surface of said wall opening, and that part of at least one of the two wall surfaces adjacent said soffit surface, said frame comprising:

a liner located ahead of, i.e. spaced from and substantially parallel to, said soffit surface;

at least one covering respectively located on one of said two wall surfaces at right angles to an adjacent edge of said liner; each covering comprises a U-shaped, thin-walled profiled member having a base which is substantially parallel to an associated wall surface, and two legs which extend perpendicular to said base; one leg of each of said profiled members faces said wall opening and projects beyond the plane of said soffit surface; said liner being mounted on the outer side of said one leg; each of said profiled members, on that side of said base thereof which faces the associated wall surface, being provided with at least one rail which extends in the longitudinal direction of said profiled member;

fastening dowels, each of which has an enlarged end which is adapted to be received by said rail in such a way as to be movable therein and to project at right angles therefrom toward the associated wall surface; that end of each of said fastening dowels remote from said enlarged end thereof being adapted to be inserted in bores operatively associated with said wall surface for effecting connection of said profiled member with said wall surface;

connection means for securely holding said liner on said one leg of said profiled member, and a wooden blind liner located between said liner and said soffit surface, said one leg of said profiled member projecting at least into the plane of the outer surface of said blind liner; in which at least the inner side of said liner, i.e. that side which faces said blind liner, comprises a wood plate having blind holes which are open toward said blind liner; and in which said connection means are securely holding said liner on said one leg of said profiled member comprises connecting dowels which are adapted to be received in said blind holes of said wood plate, and can be inserted in bores in said blind liner.

3. A frame according to claim 2, in which said one leg of at least one of said profiled members is formed as a recess for a door abutment, and is provided with a recessed surface as a door abutment surface; said recessed surface being provided with a groove-like receiving pocket which projects below the inner side of said liner, i.e., that side of said liner which faces said soffit surface; and which includes a profiled sealing member having fastening ribs which can be inserted in said receiving pocket; said liner having an end surface which is flush with said recessed surface of said one leg, said sealing member covering said end surface.

4. A frame for covering an opening in a wall, and specifically for covering the soffit surface of said wall opening, and that part of at least one of the two wall surfaces adjacent said soffit surface, said frame comprising:

a liner located ahead of, i.e. spaced from and substantially parallel to, said soffit surface;

at least one covering respectively located on one of said two wall surfaces at right angles to an adjacent edge of said liner; each covering comprises a U-shaped, thin-walled profiled member having a base which is substantially parallel to an associated wall surface, and two legs which extend perpendicular to said base; one leg of each of said profiled members faces said wall opening and projects beyond the plane of said soffit surface; said liner being mounted on the outer side of said one leg; each of said profiled members, on that side of said base thereof which faces the associated wall surface, being provided with at least one rail which extends in the longitudinal direction of said profiled member;

fastening dowels, each of which has an enlarged end which is adapted to be received by said rail in such a way as to be movable therein and to project at right angles therefrom toward the associated wall surface; that end of each of said fastening dowels remote from said enlarged end thereof being adapted to be inserted in bores operatively associated with said wall surface for effecting connection of said profiled member with said wall surface;

connection means for securely holding said liner on said one leg of said profiled member;

said one leg of at least one of said profiled members being formed as a recess for a door abutment, and being provided with a recessed surface as a door abutment surface; said recessed surface being provided with a groove-like receiving pocket which projects below the inner side of said liner, i.e., that side of said liner which faces said soffit surface; and which includes a profiled sealing member having fastening ribs which can be inserted in said receiving pocket; said liner having an end surface which is flush with said recessed surface of said one leg, said sealing member covering said end surface;

said sealing member being provided on said one leg of a first profiled member; in which said sealing member is provided at that edge thereof remote from said soffit surface with an inwardly directed angled-off portion which together with said receiving pocket forms a first insert groove for providing said connection means for securely holding one edge of said liner on said one leg of said first profiled member; and which includes a second profiled member which at that edge thereof located outwardly of said one leg thereof is provided with an inwardly directed angled-off portion which together with said one leg forms a second insert groove for providing said connection means for securely holding the other edge of said liner on said one leg of said second profiled member.

* * * * *